United States Patent [19]

Melton, Jr.

[11] Patent Number: 4,962,929

[45] Date of Patent: Oct. 16, 1990

[54] WRIST STRAP FOR ATTRACTING AN ITEM OF SPORTS EQUIPMENT TO THE WRIST

[75] Inventor: Eugene R. Melton, Jr., Fort Lauderdale, Fla.

[73] Assignee: Lacer, Inc., Fort Laudordale, Fla.

[21] Appl. No.: 390,078

[22] Filed: Aug. 7, 1989

[51] Int. Cl.[5] ..... A63B 49/00

[52] U.S. Cl. ..... 273/29 R; 273/166; 273/73 R; 119/96; 119/109; 224/220; 224/221; 224/267; 289/1.2; 289/1.5

[58] Field of Search ..... 273/165, 166, 188 R, 273/189 R, 191 B, 29 R, 29 A, 73 R; 43/87; 119/96, 106, 153, 109; 224/219–222, 267; 606/203; 2/321, 271; 124/88; 289/1.2, 1.5

[56] References Cited

U.S. PATENT DOCUMENTS

| | | | |
|---|---|---|---|
| 330,087 | 11/1885 | Binns | 289/1.2 |
| 1,924,596 | 8/1933 | Davis | 119/109 |
| 2,600,395 | 6/1952 | Domoj et al. | 289/1.2 |
| 3,884,190 | 5/1975 | Gurrey | 119/109 |
| 4,099,750 | 7/1978 | McGrew | 289/1.5 |
| 4,252,084 | 2/1981 | Willow | 119/109 |

FOREIGN PATENT DOCUMENTS

| | | | |
|---|---|---|---|
| 1480826 | 7/1977 | United Kingdom | 289/1.2 |

*Primary Examiner*—Benjamin Layno
*Attorney, Agent, or Firm*—Harry W. Barron

[57] ABSTRACT

A slip knot wrist strap attachment for an item of equipment, such as a sport racquet, is fabricated from a single piece of tubular braid. One end of the braid is inserted through the core of the tubular braid from an insertion point thereof and fed through the inside of the tube to the other end of the tube to form an inner tube, an outer tube and a holding loop. The ends of the inner tube and outer tube are inserted through the formed holding loop and the outer tube is slid over the inner tube to close the holding loop, thereby forming a sliding loop from the insertion point. The sliding loop may fit around the wrist of the equipment user and the remote end may be tied to the item of equipment during use of the equipment.

15 Claims, 2 Drawing Sheets

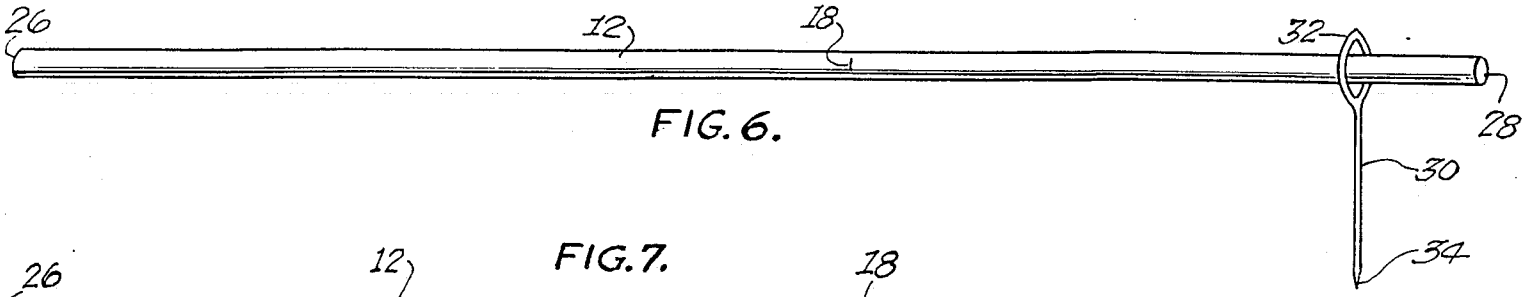
FIG. 6.
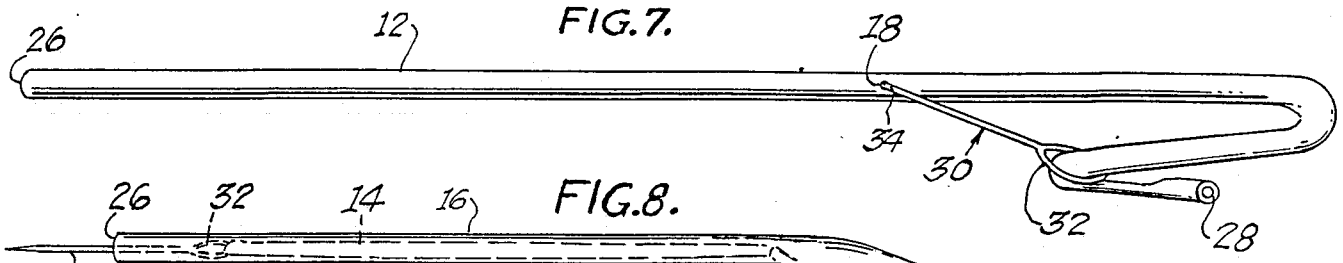
FIG. 7.
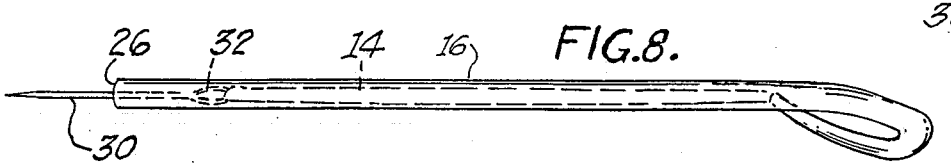
FIG. 8.
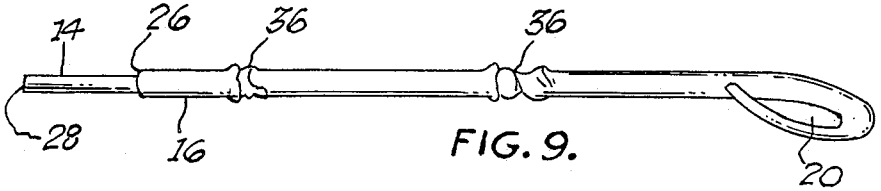
FIG. 9.
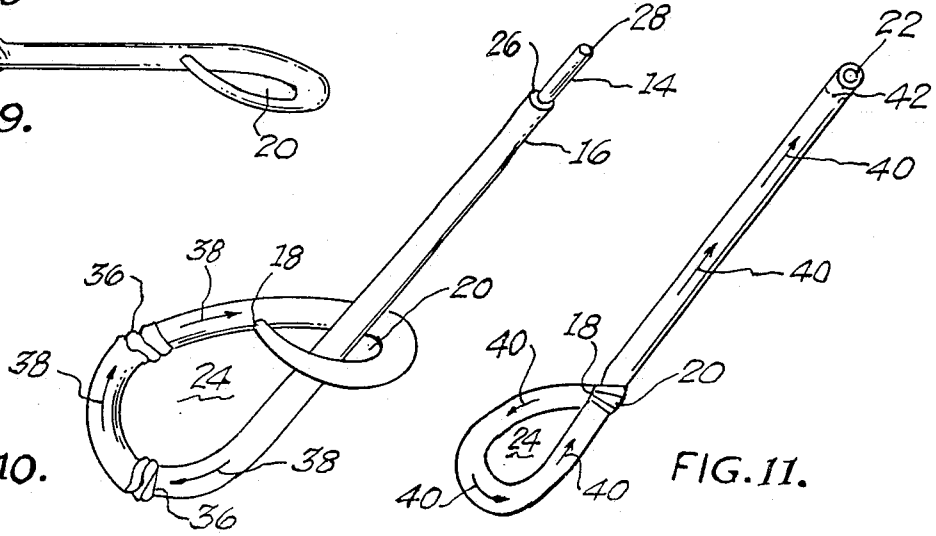
FIG. 11.
FIG. 10.

WRIST STRAP FOR ATTRACTING AN ITEM OF SPORTS EQUIPMENT TO THE WRIST

This invention relates to a wrist strap for use in attaching equipment to the wrist of a user and to a method of making such a wrist strap, and more particularly, to a wrist strap of a type of the type having a slip knot, fabricated from a single piece of tubular braid, which strap may be affixed to both the equipment and the wrist of the user during use of the user during use of the equipment.

One use for such a wrist strap is in conjunction with a sports racquet. It is mandatory in certain racquet sport games, such as racquet ball, for the players to connect a wrist strap between the racquet and their wrist to prevent the player from changing hands during a rally. Typically, such wrist straps include a loop on one end formed with a slip knot, which loop is opened to fit over the user's hand and closed so as to be against the user's wrist. The opposite end of the wrist strap, of course, is attached to the racquet handle in a conventional manner. Typically, wrist straps of the prior art have been fabricated of leather or rope and are expensive and, in many instances, uncomfortable for the user to wear.

In the modern world, sport's equipment and dress and style have become an important part of the player's image. For example, sports racquets now use color or combinations of colors to designate many different things. Modern athletes, of course, desire attractive looking equipment and color generally enhances the appearance of a sports racquet. Further, clubs, universities, and the like many times desire to use their colors on the racquets and uniforms as a team designation. Other style conscious people desire to match their sports equipment to their sports clothing, or alumni of various institutions desire to use the color of their institution. While the some sports racquets have been able to achieve various colors through different colored string and component parts, the wrist straps have tended to be bland and uncomfortable.

In addition to sports racquets, other equipment, such as cameras, umbrellas, diving equipment, skiing equipment and clothing and the like also would have need for a strap as described above. What is needed is a better equipment strap for the user to wear which is both sturdy and comfortable and which is available in various color combinations.

In accordance with one aspect of this invention there is provided a slip knot attachment between the wrist of a user and an item of sports equipment comprising a single strand of tubular braid having two ends. One of the ends is inserted from an opening in the braid through center thereof towards the other end to form a holding loop and the two ends are inserted through the holding loop to form a sliding loop.

In accordance with another aspect of this invention there is provided a method of fabricating a wrist attachment of the type affixed between an item of equipment and the user thereof, the attachment being fabricated of a single braided tubular member having two ends. The method includes the step of feeding the one end of the member through the center of the member from a central point to the other end of the member, thereby forming an inner tube, an outer tube and a holding loop. In addition, the method includes the steps of inserting the two ends through the holding loop and sliding the outer tube over the inner tube until the holding loop contacts the member. One preferred embodiment of the subject apparatus and method is hereafter described, with specific reference being made to the following figures, in which:

FIG. 6 is a view showing the first step in fabricating the wrist strap of the subject invention;

FIG. 7 is a view showing the second step in fabricating the wrist strap of the subject invention;

FIG. 8 is a view showing the third step in fabricating the wrist strap of the subject invention;

FIG. 9 is a view showing the fourth step in fabricating the wrist strap of the subject invention;

FIG. 10 is a view showing the fifth step in fabricating the wrist strap of the subject invention; and FIG. 11 is a view showing the final step in fabricating the wrist strap of the subject invention. Referring now to FIGS. 1–5, the wrist strap 10 attachment device of the subject invention will now be described. Wrist strap 10 is fabricated of a single piece of nine millimeter tubular, polyester braid. Such braid may be commercially obtained, for example, from Hickory Industries of Hickory, N.C. As is well known, tubular braid has been used for many years for various, different types of subject matter, such as common shoe laces. Tubular braid is formed by weaving together various strands of fabric material to form a cylinder, or tube, of the fabric material. By appropriately selecting the colors of the various strands, many different color variations and designs can be achieved in the final product. These designs can vary from something as simple a solid color, or a simple helical design of one or more strands throughout the tubular braid, or the designs may be a complex of diamond shaped patterns of various colors.

Figure 1:
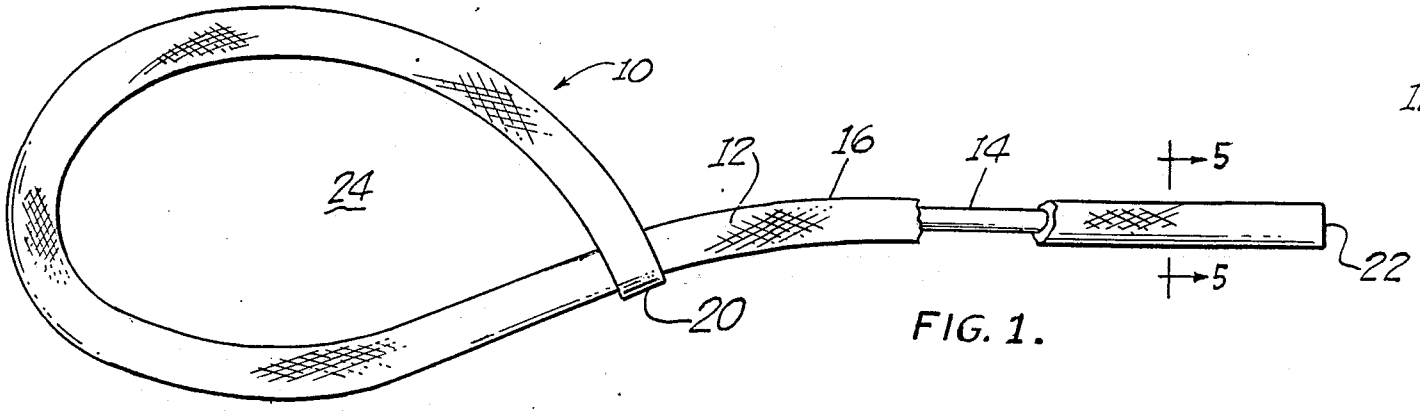
FIG. 1 is a top view of the wrist strap of the subject invention.
Figure 2:
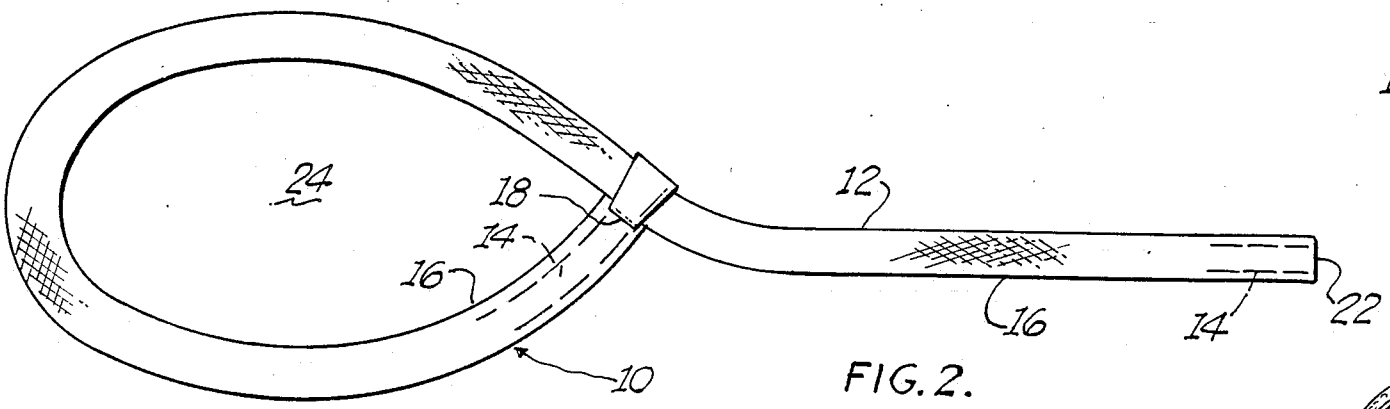
FIG. 2 is a bottom view of the wrist strap of the subject invention.

Referring specifically to FIG. 1 and 2, wrist strap 10 includes a single length of tubular braid 12, approximately 36 inches in length. While various diameter braids may be used, it has been found that the nine millimeter size is particularly attractive for making wrist strap 10. As will be explained in more detail with respect to FIGS. 6 through 11, one end of the tubular braid 12 is inserted from the center of the braid 12 towards the other end, so as to provide an inner tube 14 and an outer tube 16 of approximately one half of the overall length. The insertion occurs at insertion point 18, which is approximately midway between the two ends of the original length of the tubular braid 12. This forms a holding loop 20 through which the end 22 of the combination of the inner tube 14 and outer tube 16 is inserted. When insertion point 18 is pulled tight against the outer tube 16, a slip knot 20 is formed, thereby creating a sliding loop 24. Sliding loop 24 may be made larger or smaller by pulling the combined inner tube 14 and outer tube 16 through holding loop 20. Sliding loop 24 is to fit around the wrist of the user and end 22 is to be tied to the end of a racquet.

Figure 3:
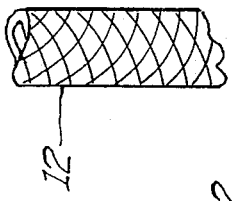
FIG. 3 is a view of the tubular braid material, when stretched, used in the wrist strap of the subject invention.
Figure 4:
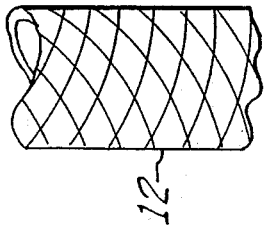
FIG. 4 is a view of the tubular braid material, when compressed, used in the wrist strap of the subject invention.
Figure 5:
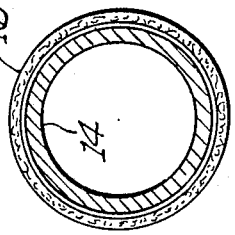
FIG. 5 is a cross-sectional view taken across lines 5—5 of FIG. 1.

Referring now to FIGS. 3, 4 and 5, the manner of placing inner tube 14 within outer tube 16 is shown. One of the features of tubular braid 12 that is important to this invention is the fact that the diameter of the braided tube can be expanded or contracted by either stretching or compressing the tubular braid 12. As seen in FIGS. 3 and 4, the tubular braid 12 material is shown in the fully stretched condition in FIG. 3 and the fully compressed condition in FIG. 4. Clearly the diameter of the tubular braid 12 in the stretched condition, shown in FIG. 3, is substantially smaller than the diameter in the compressed condition of the tubular braid 12, shown in FIG. 4. Thus, by properly adjusting the stretch/compression of tubular braid 12, the inner tube 14 may easily fit within the outer tube 16, as seen by the cross-sectional view in FIG. 5, without appreciable bunching of the tubular braid 12 material. This, in turn, permits a smooth outer surface for wrist strap 10, which can easily slide through slop knot 20.

Referring now to FIGS. 6–11, the manner of making wrist strap 10 will now be described. Specifically, as seen in FIG. 6, the initial material is tubular braid 12, which includes ends 26 and 28. The overall length of braid 12 may be approximately 36 inches in length and insertion point 18 is defined, at approximately the midpoint between ends 26 and 28. A bodkin 30 has one of ends 26 or 28 inserted through the eyelet 32 thereof. As is well known a bodkin is a large eyed blunt needle for drawing tape, ribbon and so forth through a loop or a hem. For example, as seen in FIG. 6, end 28 is passed approximately two inches through eyelet 32. Next, as seen in FIG. 7, the point 34 of bodkin 30 is inserted through insertion point 18. In so doing, a puncture is made through the skin of tubular braid 12 at point 18 and bodkin 30 is passed through the inner core of tubular braid 12. By sliding outer tube 16 over the bodkin 30 and now created inner tube 14 carried by bodkin 30, bodkin 30 will ultimately exit at end 26, as seen in FIG. 8.

After needle 30 completely exits through end 26 and is removed from end 38, the inner tube 14 will extend outward from end 26 of the outer tube 16, as seen in FIG. 9. In this circumstance a certain amount of bunching of outer tube 16 over inner tube 14 will occur, as indicated by bunches 36. When removing bodkin 30 from the end 28 if inner tube 14, care must be taken maintain holding loop 20 in place, as seen in FIG. 9. Then, as indicated in FIG. 10, the two ends 26 and 28 of the now formed outer loop 16 and inner loop 14 are passed through holding loop 20 to form sliding loop 24. Thereafter, the outer tube 16 is slid over the inner tube 14 by pushing the bunches 36 towards point 18, as indicated by the arrows 38.

As outer tube 16 slides over inner tube 14, as indicated by arrows 38, holding loop 20 shrinks in size so as to make contact with outer tube 16, as seen in FIG. 11. In addition, a reduction, but not elimination, in the size of bunches 36 results. Thereafter, the remaining bunched material of outer tube 16 is forced in the opposite direction, as indicated by arrows 40, to cause end 26 to move toward end 28. Thereafter, the remaining excess material of outer tube 16 is slid over inner tube 14 in the direction indicated by arrows 40 until the outer loop 16 is fully stretched. Then, both ends 26 and 28 are cut while at the same position and welded together by conventional techniques, such as heat sealing, used with polyester type materials.

What is claimed is:

1. A slip knot attachment between the wrist of a user and an item of sports equipment comprising:

a single strand of tubular braid having two ends in which one end is inserted from an opening in the center of said braid and through the inside of the tube towards said other end to form a holding loop and in which said two ends are inserted through said holding loop to form a sliding loop.

2. The invention according to claim 1 wherein said holding loop is formed tightly against said braid inserted therethrough.

3. The invention according to claim 1 wherein said one end is inserted through the center of said tubular braid in a direction towards the other end thereof.

4. The invention according to claim 1 wherein said two ends are welded together.

5. The invention according to claim 4 wherein said holding loop is formed tightly against said braid inserted therethrough.

6. The invention according to claim 5 wherein said one end is inserted through the center of said tubular braid in a direction towards the other end thereof.

7. The invention according to claim 1 wherein said two ends are welded together and said welded ends are inserted within said non-inserted portion of said tubular braid.

8. The invention according to claim 7 wherein said holding loop is formed tightly against said braid inserted therethrough.

9. The invention according to claim 8 wherein said one end is inserted through the center of said tubular braid in a direction towards the other end thereof.

10. The invention according to claim 1 wherein said tubular braid is of a length to permit said sliding loop to be affixed around the wrist of said user and to be secured to said equipment.

11. A slip knot attachment between the wrist of a user and an item of sports equipment comprising:

a single strand of tubular braid having two ends in which one end is inserted from an opening in the center of said braid and through the inside of said tube towards and in alignment with said other end to form a holding loop and in which said two ends are both inserted entirely through said holding loop to form a sliding loop, said two ends being affixed to one another.

12. The invention according to claim 11 wherein said two ends to be affixed to said sports equipment when said sliding loop is affixed around the wrist of said user.

13. The invention according to claim 12 wherein said tubular braid is of a length to permit said sliding loop to be affixed around the wrist of said user.

14. The invention according to claim 11 wherein said tubular braid is of a length to permit said sliding loop to be affixed around the wrist of said user.

15. The invention according to claim 11 wherein said tubular braid is of a length to permit said sliding loop to be affixed around the wrist of said user and to be secured to said equipment.

* * * * *